US007357760B1

(12) United States Patent
Rios

(10) Patent No.: US 7,357,760 B1
(45) Date of Patent: Apr. 15, 2008

(54) PADDED FREESTANDING BAG

(76) Inventor: Jason M. Rios, 8490 Renee, Newport, MI (US) 48166

( * ) Notice: Subject to any disclaimer, the term of this patent is extended or adjusted under 35 U.S.C. 154(b) by 615 days.

(21) Appl. No.: 10/793,194

(22) Filed: Mar. 4, 2004

Related U.S. Application Data

(60) Provisional application No. 60/455,387, filed on Mar. 17, 2003.

(51) Int. Cl.
*A63B 69/34* (2006.01)

(52) U.S. Cl. ..... 482/90; 482/85; 473/444

(58) Field of Classification Search ..... 482/83–90, 482/23; 473/441, 445, 444; D21/787, 798; 248/346.2, 910
See application file for complete search history.

(56) References Cited

U.S. PATENT DOCUMENTS

| | | | | | |
|---|---|---|---|---|---|
| 452,234 | A * | 5/1891 | Perry | 182/137 |
| 1,099,417 | A * | 6/1914 | Armstrong | 482/85 |
| 2,037,508 | A * | 4/1936 | Gilman | 473/444 |
| 2,143,122 | A * | 1/1939 | Dawson | 182/137 |
| 2,237,599 | A * | 4/1941 | Gilman | 473/444 |
| 2,945,550 | A * | 7/1960 | Andreasen | 182/137 |
| 3,782,724 | A * | 1/1974 | Rottman et al. | 267/140 |
| 4,770,412 | A * | 9/1988 | Wolfe | 482/85 |
| 5,281,191 | A * | 1/1994 | DeSousa | 482/83 |
| 5,624,358 | A * | 4/1997 | Hestilow | 482/90 |
| 6,106,443 | A * | 8/2000 | Kuo | 482/83 |
| 6,183,399 | B1 * | 2/2001 | Chen | 482/90 |
| 6,796,915 | B2 * | 9/2004 | Getchell | 473/446 |
| 6,893,384 | B2 * | 5/2005 | Triani | 482/83 |
| 7,063,648 | B1 * | 6/2006 | Brigham | 482/83 |

FOREIGN PATENT DOCUMENTS

| | | | |
|---|---|---|---|
| EP | 1297867 | A2 * | 4/2003 |
| GB | 2276091 | A * | 9/1994 |
| GB | 2419301 | A * | 4/2006 |
| SU | 1657213 | A * | 6/1991 |

OTHER PUBLICATIONS

Flaghouse Pole and Base Pads, Flaghouse Physical Education and Recreation catalog, Winter 1999-2000, p. 37.*
Century (TM) martial arts equipment catalog, representative of prior art, pp. 121-122; 125-128; misc.
Century (TM) martial arts equipment catalog, fall 2003, pp. 119-120.
U.S. Appl. No. 60/455,387, filed Mar. 17, 2003, A.D. Rios.

* cited by examiner

*Primary Examiner*—Jerome Donnelly
*Assistant Examiner*—Victor K. Hwang
(74) *Attorney, Agent, or Firm*—Christopher John Rudy

(57) ABSTRACT

Freestanding bag or body with a support member, and a bag or body mountable upon the support member, has at least part of the support member provided with padding to receive a striking blow.

20 Claims, 2 Drawing Sheets

PADDED FREESTANDING BAG

CROSS-REFERENCE CLAIM OF PRIORITY

This claims benefits under 35 USC 119(e) of U.S. provisional patent application No. 60/455,387 filed on Mar. 17, 2003 A.D. The complete specification of that application is incorporated herein by reference.

FIELD AND PURVIEW OF THE INVENTION

The present invention concerns a pad for striking, which is mountable to or part of a member supporting the striking bag of a freestanding training device such as a freestanding heavy bag.

BACKGROUND TO THE INVENTION

Among the aids employed in martial arts conditioning and training are the type of devices known generally as freestanding heavy bags and bodies. In such devices, a heavy bag, or a head and torso in resemblance of an opponent, is mounted to a base member either directly or through an intermediary of a supporting post. The bag or torso is designed to be struck by and withstand blows from the student such as by his head, hand, elbow, knee or foot. Generally, the bag or torso is tough but sufficiently soft to afford the student the opportunity to strike the target during training repeatedly, and this without being a cause for bruising of or other more serious injury to the student. The composition of the base member and any supporting post is generally that of a hard material such as a rigid plastic, and typically the base member takes the form of a bulbous mass having a hollow interior, into which sand or water is provided to stabilize the device for receiving the blows to the bag or body mounted thereon. Since the base, in spite of the sand or water, may slide, a cover with skid-resistant bottom and mesh sides may be mounted on the base.

It would be desirable to improve upon such systems.

SOURCE OF PROBLEM, OBJECTS, AND SUMMARY OF THE INVENTION

Heretofore, it has apparently been taken for granted, or at most simply tolerated, that a great share of the freestanding heavy bag or body, i.e., the base and any supporting post, cannot be employed as a target for striking blows during training. Such supporting parts of these devices, and in a particular way, their bulbous bases, could afford opportune target areas, especially for striking by the foot, or even the hands and so forth while laying down. Be that as it may, the supporting bases and posts of the freestanding heavy bags and bodies are unsuitable for striking by the student, owing to their hardness.

It is then, following upon such discoveries, an object of the present invention to provide for employment of a greater share of the known freestanding heavy bag or body as a target for striking during martial arts training. It is furthermore an object of the present invention to provide for suitable target areas about the supporting parts of these devices, especially about their bulbous bases. It is, moreover, an object of the present invention to ameliorate the unsuitability of the supporting posts and bases of the known freestanding heavy bags and bodies for striking by the student owing to their hardness. These and additional objects, which can be appreciated by an understanding of the art and improvements in the same as disclosed hereby, are satisfied, if not completely at least in significant part, by the present invention, a more full disclosure of which is set forth below.

Accordingly, in general, the present invention provides a freestanding bag or body comprising a support member, and a bag or body mountable upon the support member, wherein at least part of the support member is provided with padding for receiving a striking blow. Padding may be provided integral with or as an addition for the support member. As an addition, it may comprise another aspect of the invention separate from the bag or body.

The invention is useful in fitness and martial arts training.

Significantly, by the invention, the art is advanced in kind. At last, parts of the freestanding heavy bags or bodies which had been unproductive as a target in training in the martial arts or for fitness in general are provided with additional utility as a productive target area. In particular, on some freestanding bags the half or more of the portions of the bags that heretofore could not be used for striking, can be so used. Furthermore, such padded support parts as provided hereby make the entire strike-training device inherently more safe for practice, as errant or glancing blows, for example, which were intended for the bag portion of the freestanding heavy bag but which strike a support base or post, can find a generally soft, more safe area in which to be received. When the padding is provided as an addition for the support member, it may be provided as an accessory device or plurality of accessory devices. Thus, the invention can be highly practical and versatile in application. Moreover, the invention can be efficiently made and readily used.

Numerous further advantages attend the invention.

DRAWINGS OF SOME EMBODIMENTS OF THE INVENTION

The drawings form part of the specification hereof. With respect to the drawings, which are not necessarily drawn to scale, the following is briefly noted:

DETAIL FURTHER ILLUSTRATIVE OF THE INVENTION

Figure 1:
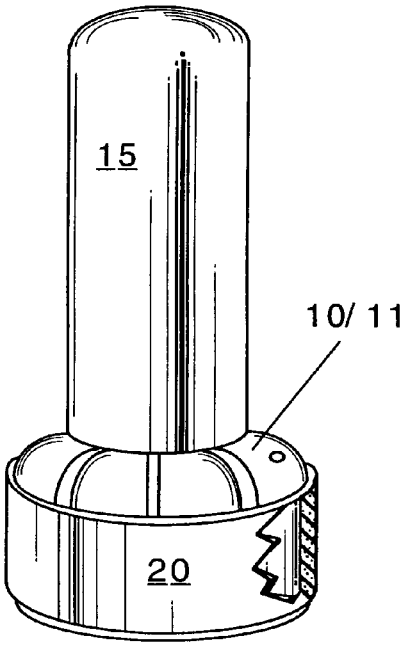
FIG. 1 is a side plan view, in partial cross section, of a freestanding heavy bag of the invention, having padding integral with the part of its support member that is padded.

The invention can be further understood by the present detail, which may be read in view of the drawings. Such is to be taken in an illustrative and not necessarily limiting sense.

In general, the freestanding bag or body of the invention can embrace a support member, and a bag or body mountable upon the support member, in which at part or the whole of the support member is padded. As the support member may be mentioned typical bases, and, as may be present with many bases, support posts that span to the striking bags or bodies. Typically, there is one base and, if present, one support post per device. As the bag or body may be mentioned various heavy bags and training torsos that are suitable for striking by physical blows. In the practice of the invention, in one aspect, at least part of the support member of a freestanding bag or body otherwise exposed to blows can be provided with padding for receiving a striking blow. In another aspect, padding for addition to the freestanding bag or body, as an accessory device, itself is provided.

Dimensions of the padding may vary as may be desired. In general, enough depth to the padding is provided to absorb blows, dependent, of course, on the materials employed in making the padding and the anticipated severity and repetition of the blows, and enough vertical length and horizontal width to the padding is provided to cover a desired area of the base and/or support post of the freestanding bag or body. When designed as an accessory padding member for the base of a freestanding striking device, special consideration may be given to the length of the padding so that excessively long padding is not provided to interfere, in particular, with the rocking motion of the round bottom bases of some freestanding bags or bodies.

The padding may be integral with a part or the whole of the support member. When so provided, for instance, the padding may be provided by making the support member of a sufficiently soft, yet strong, material that can intrinsically provide for receipt of blows without undue cause for injury or pain that would hinder training; it may be sprayed on a rigid, existing support member, and allowed to foam and adhere to the support member such as by spraying of a densely foamed, resilient plastic, say, a polyurethane, polyvinyl, and so forth, preferably to have a closed skin on the exterior; or it may initially be a separate padded member such as a canvas, nylon, leather, or plastic encased batting, or a densely foamed, resilient plastic, say, a polyurethane, polyvinyl, and so forth, preferably to have a nonforaminous or closed skin exterior, which is permanently glued or otherwise permanently affixed to part or the whole of the support member otherwise exposed to blows.

The padding may be provided as an addition for part or the whole of the support member. When so provided, for instance, the same may be attached by temporary gluing, magnetic force, use of straps, strings, or ropes, which may be wrapped, tied, buckled, clamped, screwed, attached by use of hook and loop fastening such as VELCRO (Reg. U.S. Pat. & Tm. Off.) material, and so forth. Padding may be provided as walls of a bag like contrivance into which a base of the freestanding bag or body may be inserted, and so on. Thus, the additional type padding may be provided as an accessory that can be secured to the rigid support member(s) of an existing freestanding bag or body. As this padding may be mentioned canvas, nylon, leather, or plastic encased batting, or densely foamed, resilient plastic, say, a polyurethane, polyvinyl, and so forth, preferably to have a closed skin exterior, say, of a tough vinyl. So, with such accessory, expensive freestanding heavy bags or training torsos can be modified with relative ease and small expense to exponentially increase, as it were, their training value. A preferred type of additional padding accessory is intended for the bulbous base of known freestanding heavy bags and training torsos. With such an accessory, many martial arts styles which utilize low kicks can be provided with an effective vehicle for comprehensive training.

The additional padding accessory may be employed in addition to the intrinsic padding over a support member. Thus, should the intrinsic padding wear out, an enhanced state of utility of the training device with padding may be maintained.

Figure 2:
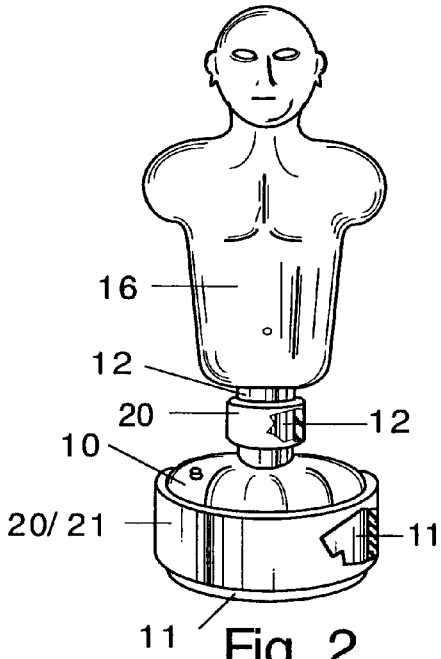
FIG. 2 is a front view, in partial cross section, of a freestanding body of the invention, having padding in addition to the part of its support member that is padded.
Figure 3:
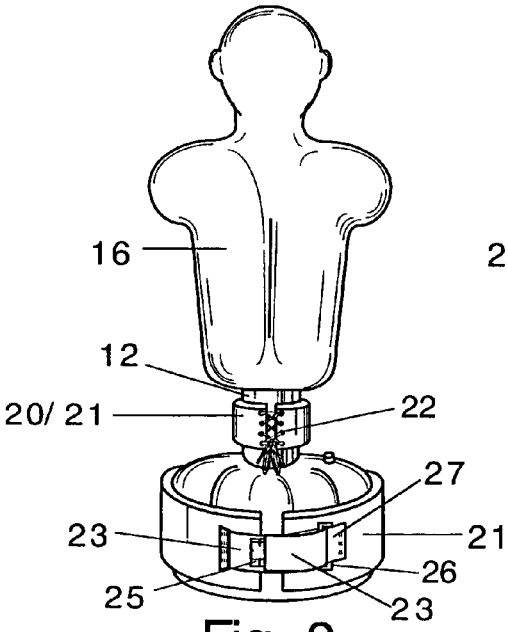
FIG. 3 is a rear view of the padded body of FIG. 2.
Figure 4:
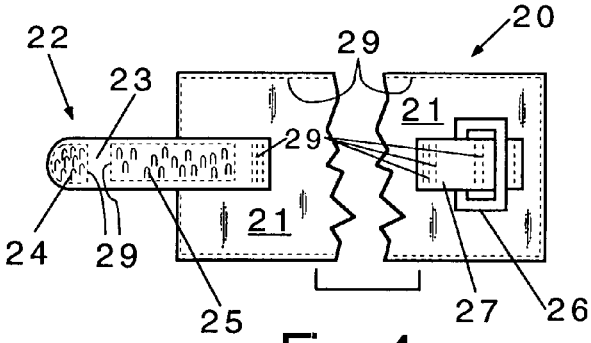
FIG. 4 is a plan view of an addable accessory, base-striking pad of the invention for attachment to existing freestanding bags or bodies, such as to the base of the body within FIGS. 2 and 3.
Figure 5:
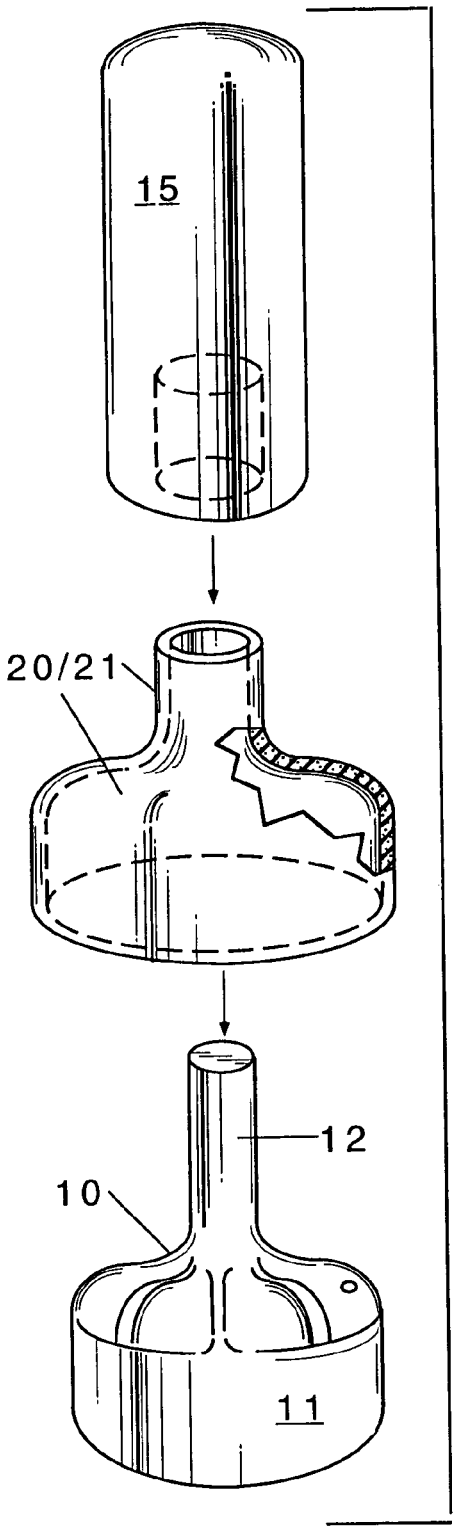
FIG. 5 is a side, exploded plan view of a freestanding bag with a slip-over pad of the invention, with the pad depicted in partial cross-section.
Figure 6:
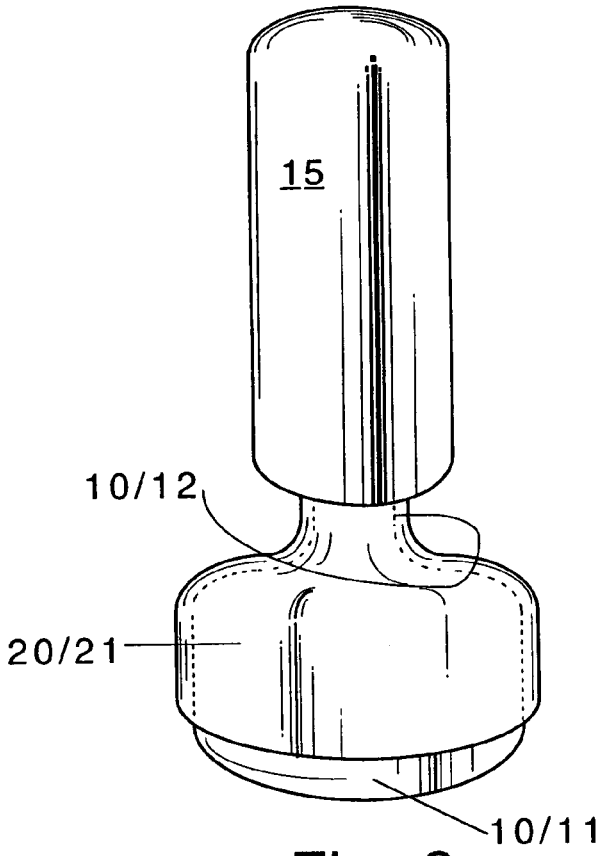
FIG. 6 is a side, plan view of the bag of FIG. 5, assembled.
Figure 7:
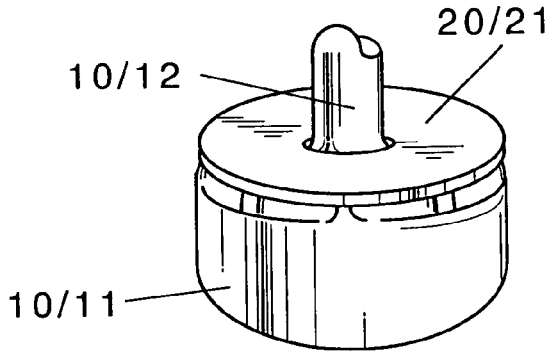
FIG. 7 is a perspective view of a freestanding bag or body, having a top pad resting on its base.

With respect to the drawings, the freestanding bag or body includes support member 10, generally including base 11, which is to be filled with sand or water, and, in certain models, support post 12. Upon the support member 10 is mounted bag 15, which may be of the well known heavy bag type having a high density and/or high impact foam covered by a durable vinyl or nylon exterior skin, or which may be a textile batting or other material covered by vinyl, nylon, canvas or leather, or body 16, which may be of the well known training torso type having filling of a urethane foam and outer coating of high strength plastisol. The bag 15 or body 16 may be considered to be an upper striking target. In the practice of the invention, a freestanding bag or body can further include padding 20, which, in general, is sufficiently stout to receive a striking blow and resilient to protect the student from excessive injury that may otherwise be caused from striking an object such as an unpadded rigid plastic, wood, or metal support member. The padding 20 may be considered to be a lower striking target. The padding 20 may be integral with part of the support member 10 (FIG. 1) and/or may be provided in addition to part of the support member 10 (FIGS. 2, 3). As an addable accessory, the padding 20 can include striking pad 21 (FIGS. 2-7) and fastening device 22 as may be desired (FIGS. 2-4). In one exemplary embodiment, the padding 20 includes striking pad 21, say, of a high density foam which is clad with a tough vinyl skin to absorb the shock of a kick while providing good quality and comfort to the student, to which is attached the means for fastening 22, for example, on securing web 23, say, a cloth strap, having hook 24 and loop 25 material attached thereto; the striking pad 21 has web receiving loop 26 attached, for example, through support web 27 to the striking pad 21; stitching 29 may be employed; the web 23 can be wrapped around the support member 10, say, the base 11, looped through the loop 26 and secured by the hook and loop, say again, VELCRO, fastener 25, 26 (FIGS. 2-4). In yet another exemplary embodiment, a pad 21 may be slipped over the top of the base 11 and post 12 while the bag 15 is removed (FIG. 5) whereupon the bag 15 can be replaced so that the pad 21 covers not only the sides but also the top of the base 11 as well as the post 12 (FIG. 6) In still another exemplary embodiment, a pad 21 may be in a form such as an annular disc that can slip over or be tied around the post 12 of a freestanding bag or body and protect the top of the base 11 (FIG. 7). Such protection of the top of the base 11 can provide for a padded target for stomping maneuvers and so forth.

CONCLUSION TO THE INVENTION

The present invention is thus provided. Various features, parts, subcombinations or combinations may be practiced with or without reference to other features, parts, subcombinations and combinations of the invention, and numerous means and adaptations may be effected within its spirit.

I claim:

1. A freestanding bag or body device useful for martial arts training comprising:

a support member having a bulbous base, and a support post projecting upwardly from the top surface of the base, on which post is mounted an upper striking target, which base is generally cylindrical in shape when taken from a top or bottom view, with a general circumference, and which base has:

a lateral outside wall, which is generally vertical in orientation, which defines the general circumference, and which has upper and lower boundaries;

a top surface, which roundedly, convexly blends into the upper boundary of the lateral outside wall, and which becomes generally horizontal in orientation about an inner portion; and a bottom;

the upper striking target, which is mountable upon the support member, which is tough but sufficiently soft such that it is suitable for striking by physical blows from a head, hand, elbow, knee or foot of a martial arts student without undue cause for injury or pain that would hinder training; and padding, which covers at least part of the support member, which padding is suitable for receiving and generally absorbing a physical, striking blow from the head, hand, elbow, knee or foot of the martial arts student without undue cause for injury or pain that would hinder training, provided that, if the padding covers less than the whole of the support member that could otherwise be exposed to receive the striking blow, the padding can protect a lower target; wherein the padding is provided in a shape of a bell, goes over and around the base, and goes over and covers the support post projecting upwardly from the top surface of the base.

2. The device of claim 1, wherein the upper striking target has a lower portion that has an outside boundary that is less than and within the general circumference of the base.

3. The device of claim 2, wherein the bottom of the support member provides for a rocking base, and the padding does not interfere with rocking.

4. The device of claim 3, wherein the padding is not integral with but is provided in addition to the support member.

5. The device of claim 3, which is a heavy bag.

6. The device of claim 3, which is a training torso.

7. The device of claim 2, wherein the padding is not integral with but is provided in addition to the support member.

8. The device of claim 2, which is a heavy bag.

9. The device of claim 2, which is a training torso.

10. The device of claim 1, wherein the bottom of the support member provides for a rocking base, and the padding does not interfere with rocking.

11. The device of claim 10, wherein the padding is not integral with but is provided in addition to the support member.

12. The device of claim 10, which is a heavy bag.

13. The device of claim 10, which is a training torso.

14. The device of claim 1, wherein the padding is not integral with but is provided in addition to the support member.

15. The device of claim 1, which is a heavy bag.

16. The device of claim 1, which is a training torso.

17. An article of manufacture comprising padding, which padding is useful as an accessory for a freestanding bag or body support member for a martial arts training device for striking blows, which support member has:

a base, which is generally cylindrical in shape when taken from a top or bottom view, which base has a general circumference, and which base has:

a lateral wall, which is generally vertical in orientation, which defines the general circumference, and which has upper and lower boundaries;

a top surface, and a bottom; and a support post projecting upwardly from the top surface of the base, which post has a lateral wall and is less in lateral thickness than the general circumference of the base, on which post can be mounted an upper striking target, which target is useful for receiving striking blows in martial arts training from a head, hand, elbow, knee or foot of a martial arts student;

which padding is useful for receiving and generally absorbing physical, striking blows in martial arts training from the head, hand, elbow, knee or foot of the martial arts student, and which padding is a bell-shaped pad, which is able to be slipped over the post and base of said member from the top to cover them both, and which bell-shaped pad has:

a lower lateral wall, which is generally vertical in orientation, which defines a first general circumference, and which has upper and lower boundaries, the lower boundary of which defines a bottom-facing opening;

a top surface, which connects to the upper surface of the lower lateral wall and is generally horizontal in orientation, at least in part;

an upper lateral wall, which connects at a lower boundary thereof to an inner portion of the top surface and is generally vertical in orientation, which defines a second general circumference that is smaller in diameter than the first general circumference, and which has an upper boundary that defines a top-facing opening;

wherein the bell-shaped pad forms a hollow volume between opposing portions of the lower lateral wall and between opposing portions of the upper lateral wall, and the bottom-facing and top-facing openings form a throughput in the hollow volume.

18. The pad of claim 17, which is made of a densely foamed plastic with a tough skin.

19. A freestanding bag or body device useful for martial arts training comprising:

a support member having a bulbous base, which base is generally cylindrical in shape when taken from a top or bottom view, with a general circumference, and which base has:

a lateral outside wall, which is generally vertical in orientation, which defines the general circumference, and which has upper and lower boundaries;

a top surface, which roundedly, convexly blends into the upper boundary of the lateral outside wall, and which becomes generally horizontal in orientation about an inner portion; and a bottom;

an upper striking target, which is mountable upon the support member, which is tough but sufficiently soft such that it is suitable for striking by physical blows from a head, hand, elbow, knee or foot of a martial arts student without undue cause for injury or pain that would hinder training; and padding, which covers at least part of the support member, which padding is suitable for receiving and generally absorbing a physical, striking blow from the head, hand, elbow, knee or foot of the martial arts student without undue cause for injury or pain that would hinder training, provided that, if the padding covers less than the whole of the support member that could otherwise be exposed to receive the striking blow, the padding can protect a lower target; wherein the padding goes on and substantially covers the top surface of the base, and the padding is in a form of an annular disc that is substantially less in height than in diameter;

and wherein at least one of the following features is present:

the bottom of the support member provides for a rocking base, and the padding does not interfere with rocking; and a support post projecting upwardly from the top surface of the base, on which post is mounted the upper striking target.

20. The device of claim 19, wherein the upper striking target has a lower portion that has an outside boundary that is less than and within the general circumference of the base.

* * * * *